United States Patent [19]

Stouffer

[11] Patent Number: 4,508,267

[45] Date of Patent: Apr. 2, 1985

[54] LIQUID OSCILLATOR DEVICE

[75] Inventor: Ronald D. Stouffer, Silver Spring, Md.

[73] Assignee: Bowles Fluidics Corporation, Columbia, Md.

[21] Appl. No.: 482,349

[22] Filed: Apr. 5, 1983

Related U.S. Application Data

[63] Continuation-in-part of Ser. No. 112,248, Jan. 14, 1980, abandoned, and a continuation-in-part of Ser. No. 218,247, Dec. 19, 1980, abandoned.

[51] Int. Cl.[3] ..... B05B 1/08

[52] U.S. Cl. ..... 239/11; 137/835; 239/284 R; 239/590

[58] Field of Search ..... 239/4, 11, 101, 102, 239/284 R, 589–590.5, DIG. 3; 137/808–812, 833, 835, 836, 839

[56] References Cited

U.S. PATENT DOCUMENTS

| | | | |
|---|---|---|---|
| 3,423,026 | 1/1969 | Carpenter | 239/284 R |
| 3,432,102 | 3/1969 | Turner et al. | 239/DIG. 3 |
| 3,709,243 | 1/1973 | Wieme | 137/833 |
| 4,052,002 | 10/1977 | Stouffer et al. | 239/102 X |
| 4,151,955 | 5/1979 | Stouffer | 239/11 |
| 4,157,161 | 6/1979 | Bauer | 239/11 |
| 4,185,777 | 1/1980 | Bauer | 239/590 X |

*Primary Examiner*—Johnny D. Cherry
*Attorney, Agent, or Firm*—Jim Zegeer

[57] ABSTRACT

The liquid spray includes an oscillator for producing a fan spray with liquid droplets of uniform size. The oscillator is constituted by a power nozzle, a pair of side walls forming a pair of vortice spaces offset from the power nozzle, a pair of inwardly extending protuberances or deflectors downstream of which are a pair of inlets to passages leading to exits adjacent the power nozzle, and an outlet throat or aperture having a pair of short wall surfaces defining an exit throat of any value selected from about 30° to about 160° so that the fan angle can be selected to be from about 30° to 160°. This structure results in an oscillator which has a relatively low threshold of pressure at which oscillations are initiated and, most importantly, the liquid is issued in a much more uniform fan pattern than heretofore possible. In a preferred embodiment the liquid is a windshield washer fluid and the oscillator is incorporated in a nozzle for an automobile windshield washer assembly for issuing a fan spray of washer fluid onto the windshield.

19 Claims, 11 Drawing Figures

LIQUID OSCILLATOR DEVICE

REFERENCE TO RELATED APPLICATION

This application is a continuation-in-part of U.S. application Ser. No. 112,243 filed Jan. 14, 1980, now abandoned, and entitled "Nozzle for Automobile Windshield Washer Assembly" (now abandoned), and a continuation-in-part of U.S. application Ser. No. 218,247 filed Dec. 19, 1980, now abandoned.

BRIEF DESCRIPTION OF THE INVENTION AND ITS BACKGROUND

In the prior art liquid oscillator nozzles as disclosed in the application of Harry C. Bray, Jr., entitled "Cold Weather Fluidic Fan Spray Devices And Method" U.S. application Ser. No. 959,112 filed Nov. 8, 1978, now U.S. Pat. No. 4,463,904, (the disclosure of which is incorporated herein by reference) and the oscillators disclosed in Bauer U.S. Pat. Nos. 4,157,161, 4,184,636 and Stouffer et al U.S. Pat. Nos. 4,151,955 and 4,052,002, and *Engineering World,* December 1977, Vol. 2, No. 4 Page 1, (all of which are incorporated herein by reference) liquid oscillator systems are disclosed in which a stream of liquid is cyclically deflected back and forth, and in the case of U.S. Pat. No. 4,157,161, *Engineering World,* and the above application of Bray, the liquid is a cleaning liquid compound directed upon the windshield of an automobile. In those which have the coanda effect wall attachment, or lock-on (*Engineering World,* for example) there is a dwell at the ends of the sweep which tends to make the fan spray heavier at ends of the sweep than in the middle. Such system works very well where a single nozzle is used to provide a fan spray from the center of the windshield as in the system disclosed in Engineering World system.

The basic object of the present invention is to provide a liquid oscillator element which produces a swept jet fan spray in which the liquid droplets are relatively uniform throughout the fan spray thereby resulting in a more uniform dispersal of the liquid.

For example, in a preferred embodiment, the liquid is a windshield washer fluid which is sprayed on an automobile windshield and the uniform droplets provide a better cleaning action. In addition, the oscillator in the present invention retains the desirable low pressure start features of the prior art as well as the cold weather start characteristics of the oscillator disclosed in the above mentioned Bray patient application.

Thus, a further object of the invention is to provide an improved liquid oscillator for automobile windshield washer systems.

SUMMARY OF THE PREFERRED EMBODIMENT OF THE INVENTION

The preferred embodiment of the invention is carried out with an oscillator constituted by a generally rectangular chamber having at the upstream end an inlet aperture for a power nozzle, an outlet aperture or throat coaxially aligned with the power nozzle or inlet aperture, the outlet aperture also having a pair of short boundary walls which have an angle between them of approximately the desired fan angle of liquid to be issued. The fan angle, as disclosed in the prior art referred to above, is related to the distance between the power nozzle and the outlet throat. A pair of spaced walls extending downstream of the power nozzle and spaced therefrom terminate in a pair of bulbous protuberances or deflectors which define the downstream ends of vortex forming spaces and the deflectors also define the vortex controlled entranceways to the inlets of a pair of liquid passages, the exits for the passages being at opposite sides of the power nozzle. While it is not critical for the proper operation of the present invention, one of the upper and/or lower walls bounding the oscillation chamber is tapered to assure cold weather oscillation.

BRIEF DESCRIPTION OF THE DRAWINGS

The above and other objects advantages and features of the invention will become apparent when considered with the accompanying drawings wherein.

DETAILED DESCRIPTION OF THE INVENTION

Figure 1B:
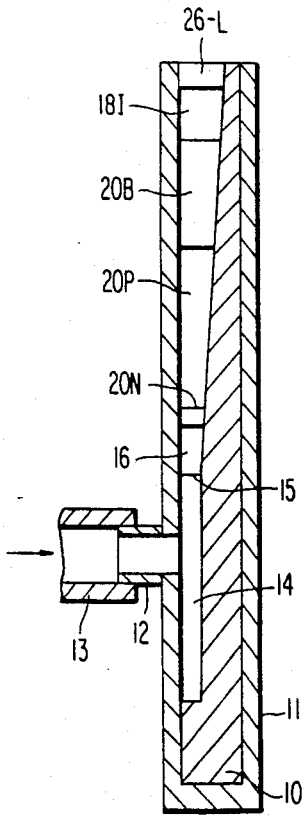
FIG. 1(*a*) is a silhouette of a preferred form of the oscillator, and FIG. 1(*b*) is a sectional side elevational view of FIG. 1(*a*)

The invention will be described in relation to automobile windshield washer assemblies. The oscillator of the present invention is constituted by a molded plastic body member 10 which would typically be inserted into a housing or holder member 11 (shown in section FIG. 1*b*) which has a fitting 12 which receives tubing 13 connection to the outlet of the windshield washer pump (not shown). Liquid washing compound is thus introduced to the device via power nozzle inlet 14 which thus issues fluid through power nozzle 15. The liquid issues from the power nozzle 15 which at its exit EP has a width W, the liquid flowing initially past the exit ports 16 and 17 of liquid passages 18 and 19 respectively. Elements 20 and 21 basically form the boundaries of the interaction chamber and the liquid passages 18 and 19, respectively. This chamber structure is defined by a pair of walls 20-N and 21-N which are normal to the central axis through the power nozzle 15 and outlet throat 24, which connect with wall elements 20-P and 21-P which are parallel to the direction of fluid flow, the normal wall elements and parallel wall elements being joined by curved section 20-C and 21-C respectively so that the liquid passages from the inlets 18-I and 19-I respectively are of substantially uniform width and about equal to the width W of the power nozzle. An important feature of the invention are the bulbous protuberances or projections 20-B and 21-B at the downstream ends of parallel portions 20-P and 21-P which have smoothly rounded surfaces. Protuberances 20-B and 21-B with outer wall portions 36 and 37 define the entranceways 38 and 39 to inlets 18-I and 19-I, respectively. The outlet throat 24 has a pair of very short diverging fan angle limiting walls 26-L and 26-R, which in this embodiment are set at an angle of about 110° and which thereby define the maximum fan angle.

While the basic structural features of the invention have been described above in relation to the invention; the following description relates to the functional characteristics of each of the major components of the invention.

POWER NOZZLE (PN)

Figure 1A:
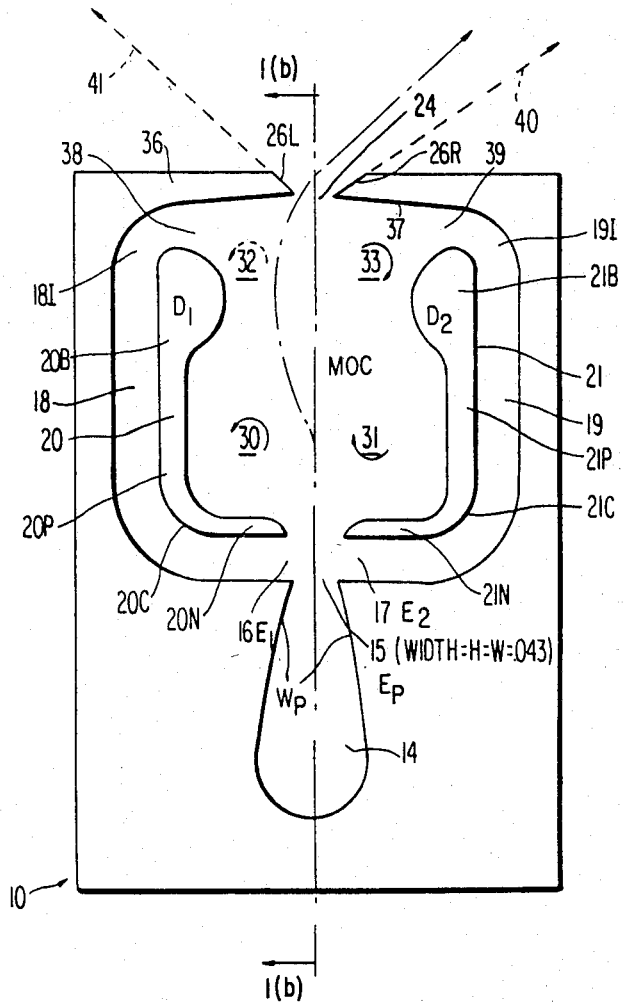

FIG. 1*a* shows that in the device the walls WP of the power nozzle, are not parallel to the power jet centerline, but converge increasingly all the way to the power nozzle exit EP, so that the power jet stream will continue to converge (and increase velocity) until the internal pressure in the jet overrides and expansion begins.

THE MAIN OSCILLATOR CHAMBER

The main oscillator chamber MOC includes a pair of left and right vortex supporting or generating volumes which vortices avoid wall attachment and boundary layer effects and hence avoid dwell of the power jet at either extremity of its sweep; the chamber is more or less square. The terms "left" and "right" are solely with reference to the drawing and are not intended to be limiting.

CONTROL PASSAGES

The control passage exits 16 and 17 (FIGS. 1 and 2) are not reduced in flow area. A reduction in flow area is sometimes used in prior art oscillators to increase the velocity of control flow where it interacts with the power jet; to restrict entrainment flow out of the control passage; or as part of an RC feedback system to determine power jet dwell time at an attachment wall. In the preferred embodiment of the invention, the control passage exits 16 and 17 of the oscillator are the same size as the passages 18 and 19. No aid to wall attachment is necessary because there are no walls on which attachment might occur.

The control inlets in many prior art oscillators are sharp edged dividers placed so that they intercept part of the power jet flow when the power jet is at either the right or left extreme of its motion. The dividers used in prior art oscillators at the control inlet direct a known percentage of the flow to the control exit (or control nozzle in some cases) in order to force the power jet to move or switch to the other side of the device. The control passages sometimes contain "capacitors" to delay the build-up of control pressure in order to lengthen the time power jet dwells at either extreme. In contrast, the control inlets 18-I and 19-I of this invention are rotated 90° relative to the usual configuration, and thus do not intercept any power jet flow. In fact, as will be described later under the heading "Method of Oscillation", there is no power jet flow in the control passages 18 and 19.

DEFLECTORS (PROTUBERANCES 20B AND 21B)

Figure 2:
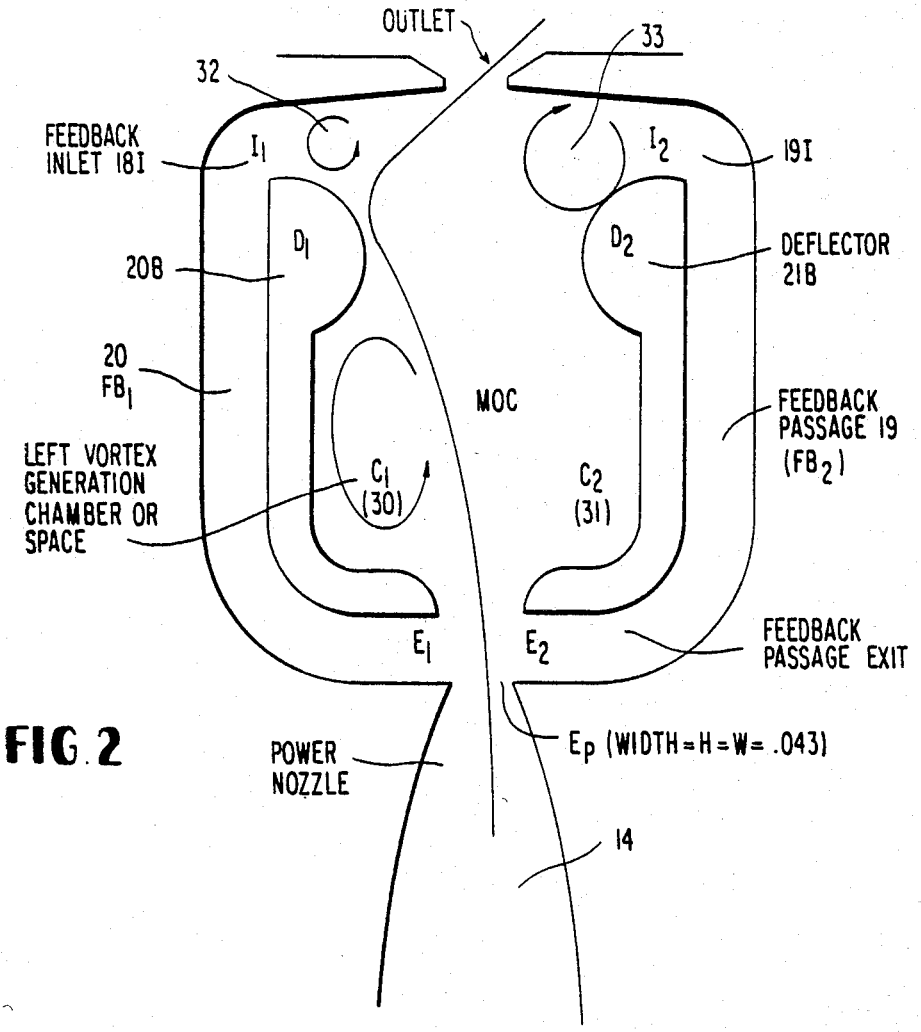
FIG. 2 is a view similar to FIG. 1(*a*), but wherein legends have been applied and some of the numbering deleted for clarity and there is shown the positions of three of the vortices and the location of the power jet at a particular instance during operation thereof, FIGS. 3*a*–3*h* diagrammatically illustrate a sequence of vortex formation and movement and resulting flow conditions in an oscillator incorporating the invention.

The partition that separates feedback passage from the main chamber MOC of the oscillator may also be seen in FIG. 2. This partition is terminated at the control passage inlet by rounded protrusion or deflector members 20-B and 21-B. This part of the partition has three functions; to deflect the power jet stream; to provide a downstream seal for the vortex generation chamber; and to form part of the feedback passage inlet.

METHOD OF OSCILLATION

Initially as supply pressure is applied to the inlet 14 of the oscillator, liquid from the power nozzle EP issues therefrom toward and through the outlet throat. The liquid jet expands such that its cross sectional area is somewhat larger than the area of the throat so that some liquid is pealed off from the jet on either side and spills back into the vortex chamber forming area. As the unit fills (from the throat toward the inlet), vortices are formed at locations 30 and 31 in FIG. 1*a*. Because of some small asymetry in geometry of pertubations in the jet, one of these vortices dominates. The other vortex diminishes and the jet is caused to move to one side of the chamber and the oscillation begins.

In this invention there are four places where vortices can exist. These locations (30, 31, 32, 33), may be seen in FIGS. 1 and 2. However, only two vortices exist during most of the cycle and never four at the same time.

Figure 3A:
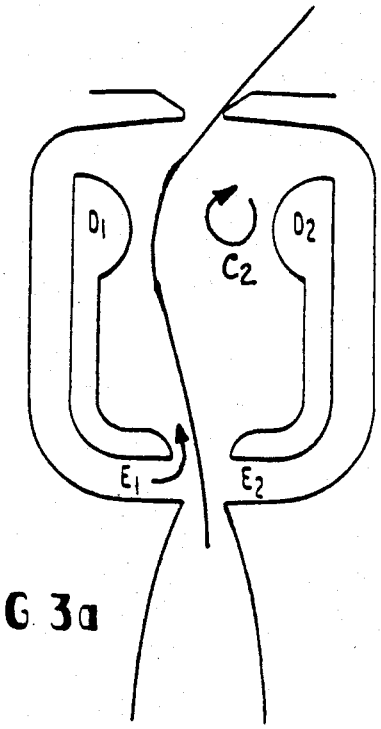

Assume the jet exiting from the outlet of the device has just arrived at the right most extreme position in FIG. 2 and 3*a*, the vortex in the left vortex generation chamber is about to form and the vortex which previously formed in the right generation chamber C2 is just leaving the right chamber. Some flow in the left control channel is entering the left chamber 30 from channel exit E1.

Figure 3B:
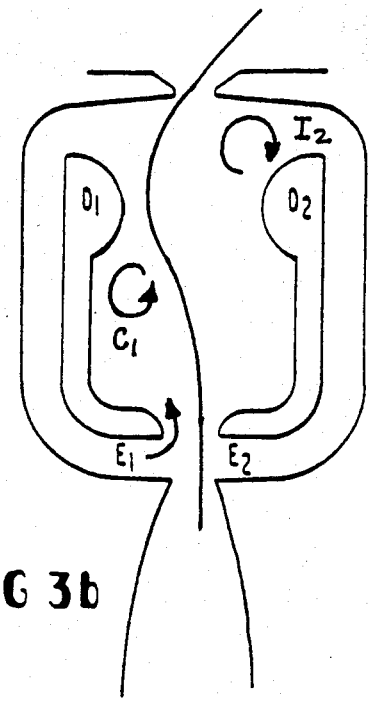
Figure 3C:
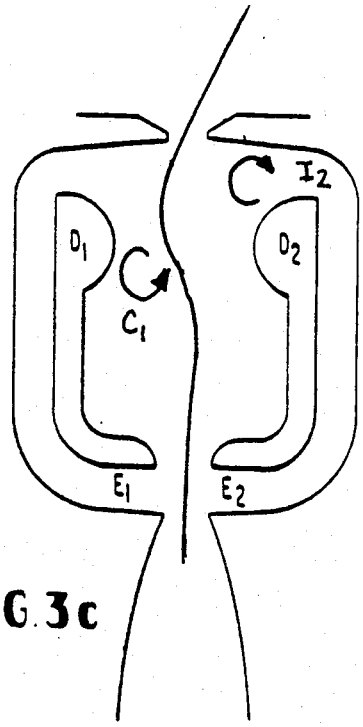
Figure 3D:
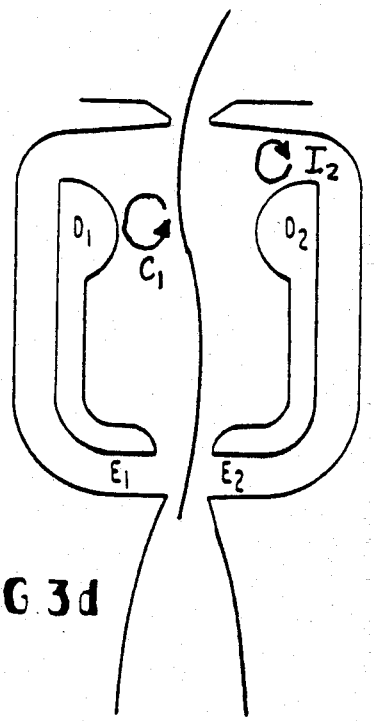

In FIG. 3*b*, left vortex C1 is formed, being supplied by fluid from the jet and the control flow from E1. The vortex C1 intensifies, expands and pushes the power jet toward the right. At the same time, right vortex C2 has moved past right deflector D2 and becomes the control passage blocking vortex I-2. Vortex I-2 influences the jet at the outlet to curve around it and deflect to the left a small amount as it issues from the outlet. FIGS. 3*c* and 3*d* show C1 moving toward the outlet over the deflector D1 all the while causing part of the jet proximate to C1 to deflect away to the right. The upper part of the jet is further influenced by the blocking vortex I-2 which forces the jet further away and increases the deflection to the left.

Figure 3E:
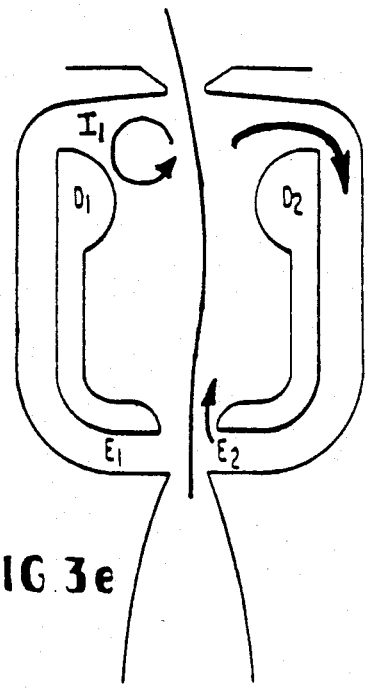
Figure 3F:
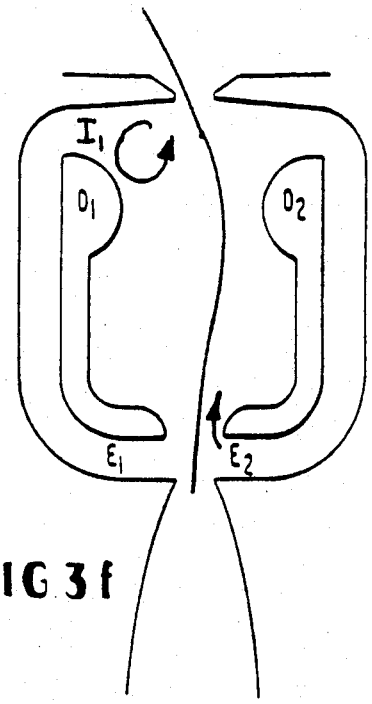

At that point and time shown in FIG. 3*d*, C1 has moved into location 38 and has become control passage blocking vortex I-1 thereby stopping the flow from E1. The power stream is nearly a straight line located near the center line of the device. The pressure in the right feedback channel 19 has been lowered by the aspiration of the power jet since vortex I-2 has been preventing flow and I-2 has suffered a loss of energy since the upper part of the jet has been deflected away. The continual lowering of the pressure in the control passage combined with the loss in energy of the vortex I-2 at location 33 results in the vortex suddenly being swallowed (FIG. 3*e*) into the control passage 19 and dissipating there.

Figure 3G:
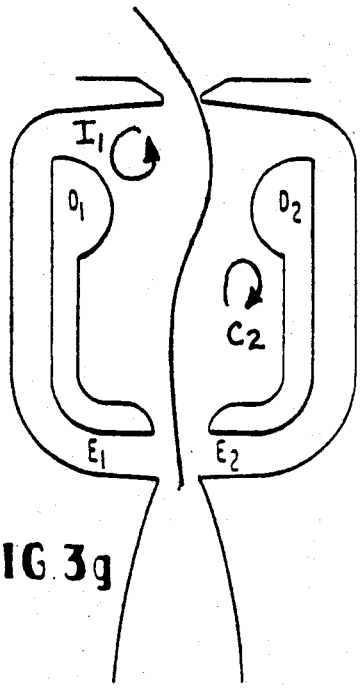
Figure 3H:
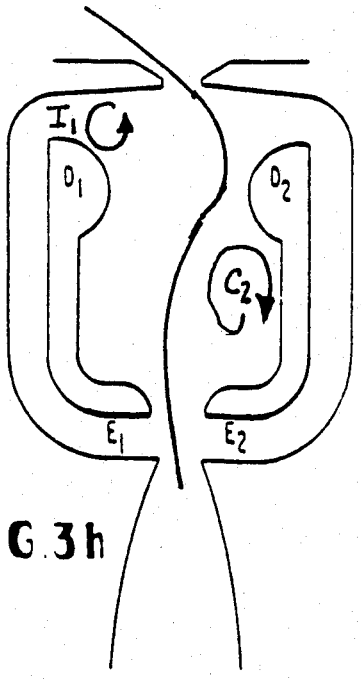

When the vortex 33 is swallowed, flow can take place in 19. The motivation for this flow is not from the usual positive pressure at the control inlet generated by splitting off part of the power jet but, it is due to a low pressure in the feedback passage 19 generated by the high velocity power jet aspirating fluid from 19 at 17. The effect of the feedback flow is:

(1) Permits the power jet to entrain flow through 19, (2) The additional flow (power jet and entrained flow) supplies the vortex 31 in the right chamber so that it can grow and move downstream, (3) The flow in the left channel 18 is blocked by the vortex I-1 which causes the pressure in 18 to be lowered by the aspirating power jet, (4) The fluid motion pattern described above generates a pressure differential across the jet to deflect it. This push-pull effect, pushing by the expanding vortex C2 and pulled by the low pressure on the left, causes the lower part of the jet to deflect to the left and, (5) The vortex I-1 in inlet 18-I not only seals the channel 18 but also influences the upper part of the power stream to deflect around it creating in conjunction with C2 an "S"-shaped deflection of the power stream shown in FIGS. 3*g* and 3*h*.

The movement of the outlet stream over one half cycle is depicted in FIGS. 3*a* through 3*h*. As shown in these figures, the outlet stream begins to move or sweep in an opposite direction by virtue of generation movement of the vortices 30 and 31 and hence before fluid flow in the feedback passage. Therefore, the motion and position of the outlet stream is not entirely dependent on control passage flow whereas the opposite is true in astable multivibrators. The angular relationship of the output stream versus time is more closely related to sinusoidal oscillation than it is to astable oscllation. This is evidenced by the fact that the output stream does not linger at either extreme of its angular movement.

The mechanism by which the droplets are formed is essentially the same as the swept jet oscillating nozzles shown in U.S. Pat. No. 4,052,002. The liquid dispersal mechanism is based on the break up of a liquid stream into drops when the liquid jet is swept in space transversely to the direction of flow. Depending on the speed and frequency, the stream breaks up into droplets in fan shaped spray pattern.

SUMMARY

The power nozzle design purposely generates turbulence in the power jet stream prior to the nozzle exit, rather than attempt to generate a "low" turbulence nozzle design with a controlled and stable velocity profile. Moreover, the power nozzle allows the power jet flow within the power nozzle to "hug" one or the other of the power nozzle's sidewalls in order to cause a closer interaction between the power jet and the exits 16 and 17 of the control passages 18 and 19, thus, enhancing the generation of very low pressures in the control passages.

The control passage exits 16 and 17 are unrestricted so there is no RC storage (e.g. capacitance or resistance effects) and permit maximum flow from the control passage. The large exits 16 and 17 also permit maximum aspiration to occur as a result of the power jet flowing across the exits. The control passages 18 and 19 are at a "low pressure-no flow" condition for most of the oscillator cycle.

Feedback is controlled by low pressure and vortex movement rather than intercepting a portion of the power jet. In fact, there is no power jet flow in the control passage. The entranceways 38 and 39 to control passage inlets 18-I and 19-I are designed to provide containment of a vortex for sealing the inlet to the control passage against flow.

The vortices produced in left and right vortex generation chambers dominate the process of oscillation and also provide a new vortex that moves into the inlet of a feedback passage to terminate each feedback occurence.

It is the vortex aided power jet control (as opposed to boundary layer or stream interaction) which is the dominant oscillatory mechanism controlling all major aspects. When a vortex moves across one of the deflectors, it forces the power jet toward the opposite deflector. In addition, this vortex, with help from a counter rotating vortex on the other side of the power jet, causes the power jet to bend sharply around the first vortex.

Since there is no wall lock-on or coanda effect utilized, there is essentially no dwell, and a uniformity of fan pattern is achieved at the relatively wide angle (in the disclosed embodiment 110° to 120°, however, I wish it to be understood that the fan angle can be any value from 30° to 160°) needed for good wetting, for example of an automobile windshield, especially where separate driver and passenger nozzles are used. The fan is in the direct line of vision. At the same time, the device retains the low threshold pressure for initiation of oscillation so in the case of a windshield washer assembly for automobiles, there is no need to increase pump sizes for cold weather operation when the viscosity and surface tension of the liquid has increased. If desired, the oscillation chamber can have the top (roof) and bottom (floor) walls thereof diverging from each other in the direction of the outlet throat so as to expand the power jet in cold weather but it is not necessary in regards to the present invention.

The device illustrated is an actual operating device. Variations of the output characteristics can be achieved by varying the curvature of protuberances 20-B and 21-B. For example, the protuberances can be flattened to control the extent of the sweep angle per se, but the fundamental operation remains the same. In addition, the fan angle can be decreased by shortening the distance between the power nozzle 15 and outlet throat 24. In the drawings, the distance between the power nozzle 15 and the outlet throat 24 is about 9W and the distance between sidewalls 20 and 21 is slightly more than 6W, the distance between protuberances 20-B and 21-B is slightly greater than 4W.

While the preferred embodiment of the invention has been illustrated and described in detail, it will be appreciated that various modifications and adaptations of the basic invention will be obvious to those skilled in the art and it is intended that such modifications and adaptations as come within the spirit and scope of the appended claims be covered thereby.

What is claimed is:

1. In a liquid oscillator having an oscillation chamber, a power nozzle for introducing a liquid power jet into said chamber, an outlet throat downstream of said power nozzle and a pair of passages having inlet openings to the respective sides of said oulet throat and exit openings adjacent said power nozzle, the improvement wherein said oscillation chamber includes a pair of mirror image wall surfaces beginning immediately downstream of said exit openings and extending to downstream therefrom and defining vortex forming chambers, the downstream end of each said wall surface being shaped to permit vortices formed in said vortex forming chambers to move thereover into said inlet openings, respectively, whereby said liquid power jet is caused to oscillate back and forth in said oscillation chamber.

2. The liquid oscillator defined in claim 1 wherein said downstream ends are smoothly curved.

3. The liquid oscillator defined in claim 1 wherein said power nozzle has converging sides and said power jet expands in said oscillation chamber.

4. The liquid oscillator defined in claim 1 wherein said oscillation chamber has top and bottom walls which diverge, relative to each other.

5. The liquid oscillator defined in claim 1 wherein said power jet creates a suction at the exit opening of the one of said pair of passages having a vortex residing in the inlet opening thereof.

6. The liquid oscillator defined in claim 1 wherein said downstream ends are smoothly curved to merge into said inlet opening.

7. The liquid oscillator defined in claim 6 wherein said power nozzle has converging walls such that said power jet expands in said oscillation chamber.

8. The liquid oscillator defined in claim 7 wherein said power jet alternately creates suction at the exit opening of one of said pair of passages having a vortex residing in the inlet opening thereof, respectively.

9. The liquid oscillator defined in claim 8 wherein said oscillation chamber is generally rectangular in shape.

10. The liquid oscillator defined in claim 1 wherein said oscillation chamber is generally rectangular in shape, said vortex forming chambers being to each side of said nozzle, respectively.

11. In an automobile windshield washer system having a supply of windshield washer liquid coupled to an oscillating spray nozzle and a pump for causing washer liquid from said supply to flow to said nozzle for issuing a jet of washer liquid upon the windshield at a selected fan angle the improvement wherein said nozzle includes an oscillator as defined in claim 1, and an outlet wall at each side of said outlet throat for limiting the fan angle of the liquid spray upon the windshield of the automobile.

12. In a windshield washer system having a liquid fan spray nozzle, said nozzle including an oscillator having an oscillation chamber, a power nozzle for introducing a liquid power jet into said chamber, an outlet throat downstream of said power nozzle for issuing the liquid of said power jet in a fan spray, and a pair of passages having inlet openings to the sides of said outlet throat and exit openings adjacent the power nozzle, the improvement comprising, a pair of mirror image wall surfaces, each mirror image wall surface extending along one side of the axis of said power nozzle and beginning immediately downstream of said exit openings and shaped to define a vortex forming chamber, and a pair of spaced apart protuberances connected to the downstream ends, respectively, of said mirror image wall surfaces, the upstream surfaces of said protuberances being shaped to permit vortices formed in each said vortex forming chamber to move downstream thereover into inlet openings of said passages, whereby the liquid of said power jet is caused to oscillate in said chamber and does not lock-on to any wall surface and the pattern of liquid in said fan spray is substantially uniform.

13. The invention defined in claim 12 wherein at least the upstream surface portions of said protuberances are smoothly curved.

14. The invention defined in claim 12 wherein said protubrances are shaped to form vortex supporting entranceways between said outlet throat and the inlet openings to said passages, respectively.

15. In a windshield washer system having a liquid fan spray nozzle for issuing a sweeping jet of wash fluid on a windshield, wherein said nozzle includes an oscillator having a chamber, a power nozzle for introducing a liquid power jet into said chamber, an outlet throat downstream of said power nozzle and a pair of passages having inlets adjacent said outlet throat and openings adjacent the power nozzle, said sweeping jet being issued from said outlet throat, the improvement comprising, a first pair of walls normal to the axis of said power nozzle and located immediately downstream of said openings, a second pair of walls parallel to the axis of said power nozzle connected to said first pair of walls immediately downstream thereof, and a pair of spaced apart, protuberances connected to the downstream end of said second pair of walls, whereby the liquid of said power jet does not lock-on to any wall surface and the pattern of liquid in said fan spray is substantially uniform.

16. The invention defined in claim 15 wherein said protuberances are smoothly curved.

17. The invention defined in claim 15 wherein said protuberances are bulbous and are shaped to form vortex supporting entranceways between said outlet throat and the inlets to said passages, respectively.

18. A fluid oscillator comprising in combination, a power nozzle, an oscillation chamber for receiving fluid from said power nozzle and being constituted by a pair of vortex inducing spaces, each vortex inducing space having an upstream end, a downstream end and an element connecting said downstream end with said upstream end, means forming a pair of passages at each side of said chamber, each passage having an inlet opening end adjacent the downstream end of said vortex inducing space and an exit opening adjacent to said power nozzle, means forming an outlet throat downstream of said inlet opening ends, whereby vortices rythmically induced in said vortex spaces move to said inlet openings and a negative pressure is induced at the exit openings of said passageways by fluid flow from said power nozzle until the vortex in said inlet opening is swallowed into said passage.

19. A method of causing a liquid jet to sweep back and forth comprising, issuing a liquid jet into a chamber having mirror image vortex forming spaces to create oppositely rotating vortices, and an outlet, causing said vortices to alternately move downstream to block respective entranceways to passages leading to exits adjacent the point of issuance of said liquid jet into said chamber and causing said jet to alternately aspirate said exits until the vortex blocking said entranceway is swallowed into the passage it is blocking, whereby said liquid jet is caused to deflect back and forth in said chamber and sweep back and forth on passing through said outlet.

* * * * *